United States Patent [19]

Fernando et al.

[11] 4,106,433

[45] Aug. 15, 1978

[54] COATING APPARATUS

[75] Inventors: Chulani Kumarlal Fernando, 736 Oakwood, Westmont, Ill. 60559; Sangarappillai Asokan, 1047 S. Lewis Ave.; Sangarappillai Nagendran, 1360 S. Finley Rd., both of Lombard, Ill. 60148; Mohanlal Randith Wickramasinghg, 1858 W. 35 St., Chicago, Ill. 60609; H. Paul Weirich, Box 164, Libertyville, Ill. 60048

[73] Assignees: Chulani Kumarlal Fernando, Westmont; Sangarappillai Asokan; Sangarappillai Nagendran, both of Lombard; Mohanlal Randith Wickramasinghg, Chicago, all of Ill.

[21] Appl. No.: 819,075

[22] Filed: Jul. 26, 1977

[51] Int. Cl.[2] ..... B05C 1/12; B05C 1/16

[52] U.S. Cl. ..... 118/212; 118/246

[58] Field of Search ..... 118/211, 212, 221, 235, 118/244, 246, 253, 258, 259, 261, 262; 427/428; 68/202, 203

[56] References Cited

U.S. PATENT DOCUMENTS

| | | | |
|---|---|---|---|
| 2,308,168 | 1/1943 | Garson | 118/419 |
| 3,025,829 | 3/1962 | Smith | 118/235 X |
| 3,084,664 | 4/1963 | Perlman et al. | 118/235 |
| 3,735,733 | 5/1973 | Henc | 118/261 |

*Primary Examiner*—Morris Kaplan

*Attorney, Agent, or Firm*—Bernard L. Kleinke

[57] ABSTRACT

The method and apparatus for applying a liquid to a movable web of moisture-absorbent material, such as toilet paper or other roll paper sheet material, includes providing a container for storing a quantity of the liquid to be applied to the web, causing the web and the container to be moved relative to one another to apply the liquid from the container to the web in a first pattern. Simultaneously therewith, the liquid is also applied to the web in a second pattern which is spaced transversely from the first pattern to enable the web to retain its structural strength as it becomes wet.

8 Claims, 4 Drawing Figures

FIG. 1
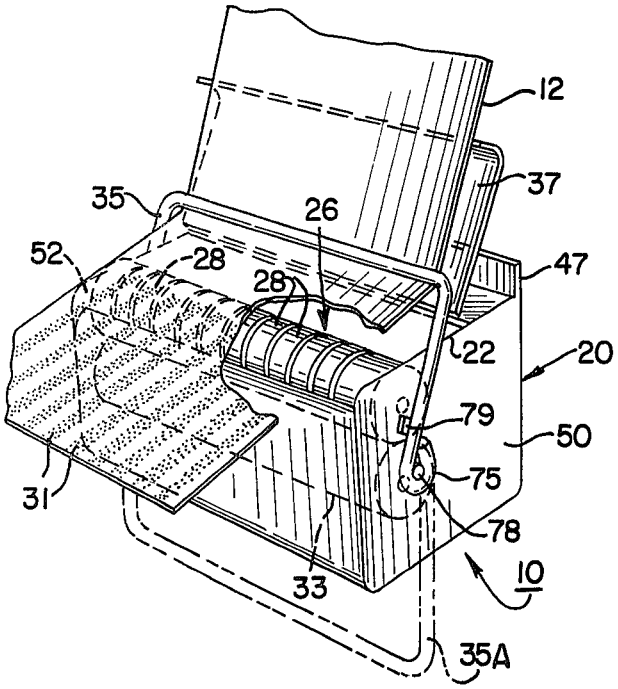
FIG. 2
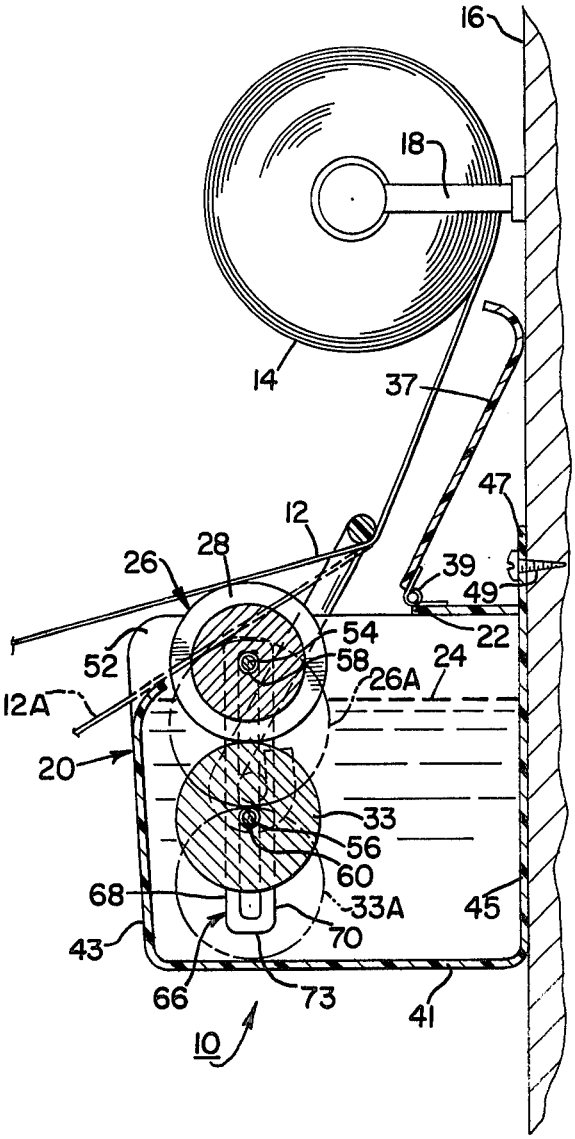
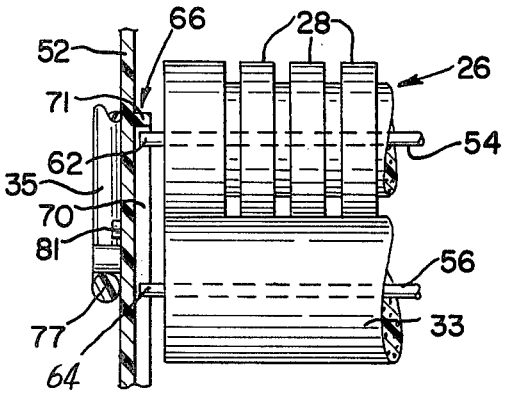
FIG. 3
FIG. 4
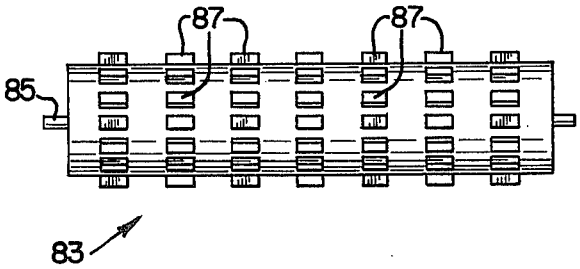

COATING APPARATUS

The present invention relates in general to apparatus for applying liquid to a web, and it more particularly relates to apparatus for applying a liquid antiseptic deodorant solution to a web of toilet paper.

Moistened sheets of moisture-absorbent material have been used for cleaning purposes, since they clean more efficiently when wet. Therefore, it would be highly desirable to have an efficient method and apparatus for applying moisture to moisture-absorbent materials, such as toilet paper and paper towels. For example, reference may be made to the following U.S. Pat. Nos.: 2,789,725; 3,865,271 and 3,995,582. However, none of the devices and methods disclosed in the foregoing mentioned patents appears to be very convenient to use. For example, it would be highly desirable to have a method and apparatus which could conveniently moisten toilet paper as it is being drawn from its roll in a convenient manner. Such a method and apparatus should apply a sufficient quantity of a liquid, such as a deodorant antispectic solution without causing the moisture-absorbent toilet paper from losing its structural strength and falling apart. On the other hand, sufficient moisture should be applied to the toilet paper to facilitate greatly the cleaning ability thereof. Moreover, such a method and apparatus should be adapted to be employed with existing toilet paper holders so that the user can decide whether or not to apply the liquid to the toilet paper. Additionally, such a method and apparatus should be extremely convenient to use. In this regard, the user should be able to apply the liquid as the toilet paper is being pulled from its roll.

Therefore, the principal object of the present invention is to provide a new apparatus for applying a liquid to a moisture-absorbent web of material in a convenient manner.

Another object of the present invention is to provide such a new and improved apparatus for applying liquid to a moisture-absorbent web so that a sufficient amount of liquid is applied without causing the material to lose its structural strength and fall apart.

Briefly, the above and further objects of the present invention are realized by providing apparatus for applying liquid to a web, which apparatus includes means for storing a quantity of the liquid in a container and then moving the web and the container relative to one another. Liquid is applied to the web in a first pattern, and simultaneously therewith, is applied to the web in a second pattern which is spaced transversely from the first pattern. In this manner, the web of moisture-absorbent material does not lose its structural strength and can be used subsequently for cleaning purposes. In this manner, for example, liquid can be applied to conventional single or double ply toilet paper without causing it to disintegrate and without the necessity of providing backing sheets or the like for the toilet paper.

Other objects and advantages of the present invention will be seen in the following detailed specification and drawings, wherein:

FIG. 1 is a pictorial view of an apparatus, which is adapted to apply a liquid to a web of moisture-absorbent material, and which is constructed in accordance with the present invention;

FIG. 2 is a cross-sectional elevational view of the apparatus of FIG. 1;

FIG. 3 is a front elevational detailed view of a portion of the apparatus of FIG. 1; and FIG. 4 is an elevational view of a roller of another apparatus for applying liquid to moisture-absorbent materials, which apparatus is also constructed in accordance with the present invention.

Referring now to the drawings, and more particularly to FIGS. 1 and 2 thereof, there is shown a liquid applicator 10, which is constructed in accordance with the present invention and which is adapted to apply liquid to a toilet paper web 12 from a roll 14 of toilet paper mounted on a wall 16 for rotation about its axis by means of a toilet paper holder 18. While it is to be understood that the liquid applicator 10 shown and described herein is used for toilet paper, various different types and kinds of moisture-absorbent material, such as paper towels, may also be used with the liquid applicator of the present invention as will become apparent to those skilled in the art. The liquid applicator 10 generally comprises a container 20 having an open mouth 22 at the upper surface thereof for confining a supply of liquid 24, such as a suitable antiseptic solution which may also contain a deodorant or other suitable materials. A roller 26 transfers the liquid 24 to the underside of the toilet paper web 12 for moistening it. A series of transversely spaced-apart high areas or lands 28 on the roller 26 apply the liquid 24 to a series of transversely spaced-apart moistened areas or stripes 31 to the web 12 as best seen in FIG. 1 of the drawings, so that when the moistened web is torn free from the web 12 and folded over for use, the moistened web 12 retains its structural strength and yet facilitates its cleaning ability.

The roller 26 is disposed and at least partially extends through the open mouth 22 to engage the web 12 moving relative thereto during use. In order to deliver substantially all of the liquid 24 from the container 20, a feed roller 33 is rotatably mounted below the upper roller 26 and extends parallel thereto. As a result, when the web 12 is pulled over the roller 26, the roller 26 revolves about its axis and in turn drives the feed roller 33 in an opposite direction to deliver the liquid 24 from the bottom portion of the container 20 to the upper roller 26.

In order to guide the web 12 from the roll 14 past the upper roller 26, a U-shaped guide bar 35 presses the traveling web 12 against a door 37 hinged at 39. The door 37 is normally disposed in its open position as shown in FIG. 2 of the drawings with the back end thereof resting against the wall 16. It should be understood that the door 37 may be moved to a closed position over the open mouth 22 when the applicator 10 is not in use to prevent or at least reduce the amount of evaporation of the liquid 24. For the purpose of moving the door 37 to its closed position, the guide bar 35 swings from its use position shown in solid lines in FIG. 1 of the drawings to the phantom line position shown in FIG. 1 of the drawings to free the web 12 and thus to permit the door 37 to swing down into a horizontal position to close the open mouth 22 of the container 20 on top of roller 26.

Considering now the container 20 in greater detail with reference to FIG. 2 of the drawings, the container 20 includes a bottom wall 41 and a pair of upstanding front and rear walls 43 and 45, respectively. A perforated extension 47 of the rear wall 45 is adapted to receive screws 49 to fasten the liquid applicator 10 to the wall 16. A pair of end walls 50 and 52 rotatably support the opposite ends of a pair of axle rods 54 and 56 extending through the respective axle rod holes 58 and 60 in the respective rollers 26 and 33, the axle rods fitting snugly and frictionally in place within their respective holes. The axle rod ends 62 and 64 of the respective rollers 26 and 33 fit within a guide track 66 on the end wall 52 as best seen in FIG. 3 of the drawings. Similarly, a second guide track (not shown) similar to the guide track 66 is mounted on the inside of the opposite end wall 50 to guide the opposite ends (not shown) of the axle rods. The guide tracks permit the axle rods 54 and 56 to rotate freely about their axes.

In accordance with the present invention, as the level of the liquid 24 changes due to liquid being transferred from the container 20 to the web 12, and also due to evaporation, the rollers 26 and 33 retract inwardly into the container 20. The rollers continue to retract until substantially all of the liquid 20 is transferred from the container 20, at which point the rollers 26 and 33 are positioned as indicated in phantom lines at the respective positions 26A and 33A as shown in FIG. 2 of the drawings. In order to enable the rollers 26 and 33 to retract into the container 20 as the level of the liquid 24 recedes, the rollers 26 and 33 are each composed of a buoyant light-weight material, such as styrofoam, to float in the liquid 24. Thus, when the container 20 is filled as shown in FIG. 1 of the drawings, the rollers 26 and 33 float in a position as shown in solid lines so that the upper roller 26 is positioned partially out of the container 20 within its open mouth 22, whereby the web 12 can be pulled into engagement with the annular high areas 28 to moisten it. Thus, as the level of the liquid 24 recedes, the two rollers retract into the container 20.

When the rollers 26 and 33 are disposed as shown in phantom lines in FIG. 2 of the drawings, the web 12 then is guided from the guide bar 34 into engagement with the high areas 28 as indicated in phantom line at 12A.

Thus, as the rollers 26 and 33 float upwardly or downwardly, they are limited in their forward or backward direction and are permitted to move in a vertical direction only.

Both of the guide tracks are similar to one another, and therefore only the guide track 66 need now be described. The guide track 66 includes a pair of parallel spaced-apart vertical bars 68 and 70 for receiving the axle ends 62 and 64 therebetween. A pair of upper and lower stops 71 and 73 interconnect the respective upper and lower portions of the vertical bars 68 and 70 to complete the track 66.

The guide bar 35 has a pair of hook-shaped ends 75 and 77 which loosely receive a pair of posts, such as the post 78 (FIG. 1), extending outwardly from the outer surfaces of the opposite end walls 50 and 52 of the container 20. As.a result, the guide bar 35 swings about the posts which are aligned with one another to form an axis of rotation.

In use, after the roll 14 of toilet paper is mounted to the wall 16 by means of the holder 18, and the liquid applicator 10 is fixed to the wall 16 directly below the roll 14 of toilet paper by means of the screws 49, the interior of the container 20 is filled with the liquid 24 to the level as shown in FIG. 2 of the drawings. The liquid is poured into the container 20 through its open mouth 22 to a level as indicated in FIG. 2 of the drawings after the door 37 is swung to its open position with its upper end portion resting against the wall 16

Initially, the guide bar 35 is hanging downwardly from its post as indicated in phantom lines at 35*a* of FIG. 1 to permit the leading edge of the paper web 12 to hang downwardly in front of the door 37. Thereafter, the user may grasp the guide bar 35 and swing it about an axis extending through the hook-shaped end portions 75 and 77 thereof until it engages and extends across the web 12 as shown in the solid lines in FIGS. 1 and 2 of the drawings. In order to move it to such a position, the U-shaped guide bar 35 moves over a pair of stops or abutments 79 and 81 to retain releasably the guide bar 35 in a backwardly inclined position. In this regard, the bar 35 is inclined slightly backwardly so that it tends to fall in that direction under the force of gravity. When the paper web 12 is pulled to withdraw a strip thereof from the roll 14, the web 12 pulls the guide bar 35 forwardly until the side legs of the guide bar engage the stops 79 and 81. Thus, the guide bar 35 exerts very little resistance to the movement of the paper web. The smooth round cross-sectional shape of the guide bar also helps in that regard.

With the door 37 disposed in its open position as shown in FIGS. 1 and 2 of the drawings, the upper roller 26 is disposed partially out of the open mouth 22 of the container 20 so that the leading edge of the toilet paper web 12 can be guided from the guide bar 35 into engagement with the upper surfaces of the annular high areas or lands 28.

In this position, the user may grasp the leading edge of the toilet paper web 12 and pull it away from the wall 16 while applying a slight downwardly directed pressure on the web 12 to maintain it in engagement with the high areas 28 of the roller 26. As a result, the web 12 frictionally engages the high areas 28 to cause the roller 26 to rotate about its axis. Thus, the annular high areas 28 apply the liquid 24 to the underside of the web 12 in the moistened areas or stripes 31 as best seen in FIG. 1 of the drawings.

As the upper roller 26 rotates, it in turn causes the lower feed roller 33 to rotate about its axis and thus to feed liquid from the lower portion of the interior of the container 20 to the underside of the upper roller 26.

Once a desired portion of the web 12 is pulled away from the wall 16 over the upper roller 26, the user then can tear off the desired portion in a conventional manner so that the thus separated portion can be folded over several times onto its self to form a pad for cleaning purposes. The liquid impregnated portion of the web thus separated from the remaining portion of the roll 14 retains its structural strength even though the entire pad is moistened with the liquid 24 to facilitate the cleaning operation.

As more and more of the liquid 24 is consumed and lost through evaporation, the rollers 26 and 33 retract into the interior of the container 20 since they float in the liquid 24. Thus, the feed roller 33 is able to continue to transfer liquid from the container 20 to the upper roller 26 even though the level of the liquid is near the bottom wall 41 below the axis of rotation of the roller 33 and thus below the roller 26 which extends through the open mouth 22 to enable the web 12 to come into contact therewith.

Should the user desire to use the web 12 without first moistening it, the guide bar 35 is swung from its normal use position past the stops 79 and 81 which are releasably secured in use position in a counterclockwise direction as viewed in FIG. 2 of the drawings until it hangs downwardly in the phantom line position indicated at 35*a* of FIG. 1 of the drawings. At such a position, the web 12 can be freely pulled from the roll 14 in a conventional manner.

Referring now to FIG. 4 of the drawings, there is shown a roller 83, which may be used in place of the roller 26 of the applicator 10 of FIGS. 1 through 3 of the drawings, and which is constructed in accordance with the present invention. The roller 83 is similar to the roller 26, except that the roller 83 does not include a series of annular high areas, but instead a series of discrete raised areas arranged in rows.

The roller 83 includes an axle rod 85 extending throughout its length and projecting outwardly from the opposite ends of the roller 83 in a similar manner as the axle ends 62 and 64 project from the opposite ends of the rollers 26 and 33, respectively.

A series of raised square-shaped areas or lands 87 are arranged in a series of axially spaced-apart rings along the roller 83. Each one of the lands 87 in a ring is spaced equally apart from one another. Thus, the raised square-shaped areas 87 apply liquid to a web in a series of discrete square-shaped areas along a moistened strip on the underside of the web.

It will be readily apparent to those skilled in the art that the present invention provides a novel and useful improvement for liquid applicators of the character described herein. The arrangement and types of structural components utilized in the invention may be subject to numerous modifications well within the purview of this invention and it is intended only to be limited to a liberal interpretation of the specification and appended claims.

What is claimed is:

1. Apparatus for applying liquid to a movable web of moisture-absorbent material, comprising:

an open mouthed container supply means for said liquid;

rotatable , buoyant applicator roll means horizontally mounted and at least partially disposed within said container to float on said liquid whereby to apply liquid to said web when operatively associated therewith;

said roller being journalled in vertical guide-slot means whereby to adapt to change in level of said liquid;

movably mounted cover means adapted in a first position to close said container including the roll therein and in a second open position to permit utilization of said applicator roll;

a horizontally disposed guide bar element comprised of a U-shaped member, pivotally mounted on said container and adapted in a first raised position to hold a lead section of said associated web against a rearwardly disposed surface of said apparatus;

stop means disposed on a forward section of said container and operatively associated a feed motion of said associated web, which is threaded between said bar and said surface, said bar is carried forward against said stop and the web then being movable across the roll to receive the liquid; and said member being adapted to be selectively moved forwardly past said stop means whereby the cover may be moved to the closed position when it be desirable to selectively utilize the web in a dry condition.

2. Apparatus according to claim 1, wherein said rearwardly disposed surface comprises the cover means in said second position.

3. Apparatus according to claim 2, wherein said cover is pivotally mounted.

4. Apparatus according to claim 1, wherein said U-shaped member is comprised of a flexible material.

5. Apparatus as in claim 1, wherein a second rotatable buoyant roll means is journalled in said vertical guide slot;

said second roll being disposed below and in contact with the applicator roll whereby to float in unison therewith and adaptable to be rotated when rotary motion is imparted to said applicator roll; and whereby said second roll is functional as a liquid transfer means when the liquid level falls below the applicator roll.

6. Apparatus according to claim 1, wherein said selective means includes a plurality of raised areas on said roller.

7. Apparatus according to claim 6, wherein said raised areas are in the form of annular lands axially aligned with said roller.

8. Apparatus according to claim 6, wherein said raised areas are spaced-apart discrete areas arranged in spaced-apart annular rows.

* * * * *